United States Patent [19]

Laurent

[11] Patent Number: 4,869,022

[45] Date of Patent: Sep. 26, 1989

[54] DEVICE FOR CONTROLLING A SIDE-HUNG LEAF OF A DOOR OR WINDOW

[75] Inventor: Aumercier Laurent, Phalsbourg, France

[73] Assignee: Ferco International, Sarrebourg, France

[21] Appl. No.: 201,876

[22] Filed: Jun. 3, 1988

[30] Foreign Application Priority Data

Jun. 12, 1987 [FR] France ..... 87 08325

[51] Int. Cl.[4] ..... E05C 17/00

[52] U.S. Cl. ..... 49/394; 49/346

[58] Field of Search ..... 49/394, 346, 339, 250, 49/260, 261, 342, 341

[56] References Cited

U.S. PATENT DOCUMENTS

| | | | |
|---|---|---|---|
| 339,140 | 4/1886 | Brown | 49/260 X |
| 1,327,754 | 1/1920 | Cade | 49/394 X |
| 1,422,552 | 7/1922 | Fournier | 49/342 |
| 1,511,010 | 10/1924 | Spencer, Jr. | 49/346 |
| 2,108,289 | 2/1938 | Laddon | 49/250 X |
| 2,187,078 | 1/1940 | Grigsby | 49/261 |
| 2,321,800 | 6/1943 | Cordrey et al. | 49/342 |
| 2,610,848 | 9/1952 | Carlston et al. | 49/342 |
| 3,994,095 | 11/1976 | Hare | 49/394 X |
| 4,392,330 | 7/1983 | Buhr | 49/260 X |

*Primary Examiner*—Philip C. Kannan

*Attorney, Agent, or Firm*—Sandler & Greenblum

[57] ABSTRACT

This device for controlling the leaf (5) of a door or window opening to the outside comprises a casing (6) secured to the inner face of the sill (4) of the dormant frame (3) and adapted to house a crank-actuated mechanism for controlling the rotation of an operating arm (7) provided at its end with a roller (13) engaging a guide rail (15) secured to the leaf (5). Protection means (19) are provided for preventing the access to the operating arm (7), notably at the beginning and at the end of the opening and closing movements of the leaf. Locking means (42) are also provided for locking the leaf (5) in any angular position thereof with respect to the dormant frame (3).

10 Claims, 2 Drawing Sheets

FIG. 1
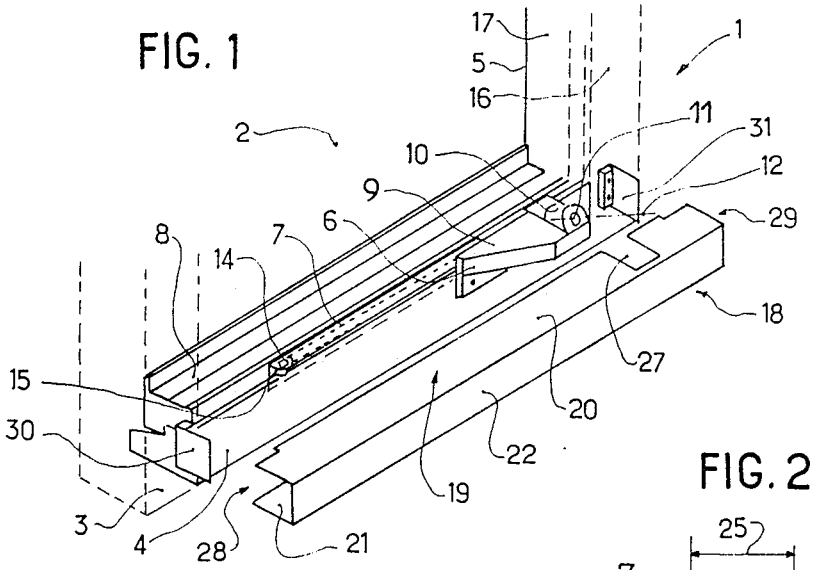
FIG. 2
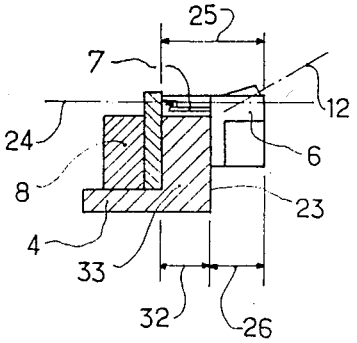
FIG. 3
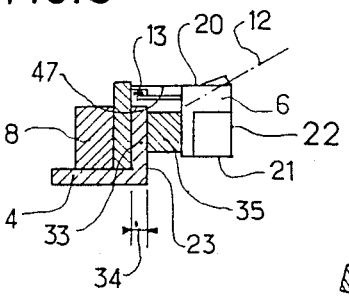
FIG. 4
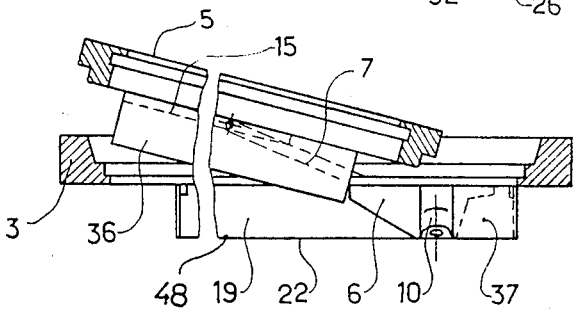
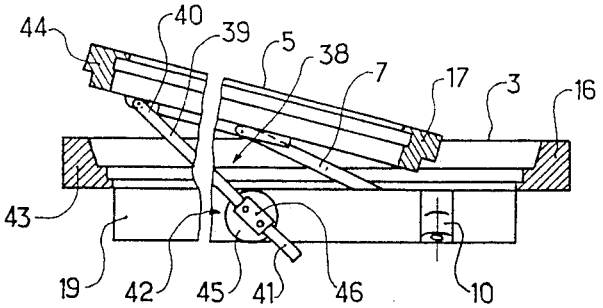
FIG. 5

DEVICE FOR CONTROLLING A SIDE-HUNG LEAF OF A DOOR OR WINDOW

BACKGROUND OF THE INVENTION

1. Field of the Invention

The present invention relates to a device for controlling a leaf or panel of a side-hung casement door or French window opening to the outside, which comprises a casing secured to the bottom sill of the fixed frame and adapted to house a mechanism actuated by means of a crank for controlling the rotation of an operating arm provided at its end with a roller engaging a guide rail fixed to the movable frame of the door or window.

This invention is applicable notably in the housing industry, more particularly and advantageously to the frame of a casement door or window opening to the outside, such as the so-called French window.

2. The Prior Art

Devices permitting of controlling the opening and closing of the leaf of a casement door or window from the fixed frame are used chiefly in countries where the degree of atmospheric humidity is particularly high during certain periods of the year. In fact, under these conditions, dwellers are compelled to line all the glazed surfaces with mosquito-netting to prevent these frequently abundant flying insects from penetrating into their houses. Now, since French windows open to the outside, such mosquito-netting can only be fitted on the inner side of the door or window. As a rule, mosquito-nettings consist of screen having a relatively aerated texture to facilitate the air circulation while preventing the passage of the flying insects through the netting. On the other hand, this screen is usually kept taut in an auxiliary frame secured to the dormant of the door or window.

Since such mosquito-nettings are useful only during one period in the year, in most cases they can be removed from the door or window frame. However, to avoid successive fittings and removals of the mosquito-nettings each time the casement leaf is to be closed or opened, the doors or windows are provided with a control device permitting the remote control of the casement leaf, notably from the lower sill of the frame. Besides, during those periods in which flying insects are particularly abundant, it is preferably to avoid removing at any time the mosquito-nettings, otherwise the insects would penetrate in great number into the house.

A device for controlling a side-hung casement door or window leaf opening to the outside and comprising the above-mentioned component elements is already known in the art. Thus, this known control device comprises a fixed casing secured to the bottom sill of the door or window frame, and this casing encloses a mechanism for controlling the rotation of an operating arm pivoting in the casing and connected to the door or window leaf. This mechanism consists essentially of an endless screw driven for rotation by means of a crank and engaging teeth formed on the end of the operating arm in the casing. Due to the mounting of the casing on the bottom sill of the fixed frame, the axis of rotation of the endless screw of this control device is inclined at an angle of about thirty degrees from the horizontal to facilitate the actuation of the crank, so that the window-sill cannot interfere with the free rotation of this crank.

This type of control device is generally associated with a set of compass arms disposed in the fillister of the fixed frame or of the leaf, thus causing this frame or leaf not only to rotate about a vertical axis extending along its rear stile but also to accomplish a movement of translation parallel to the plane of the fixed frame of this axis of rotation of the leaf. The advantage resulting from the combination of these two movements (rotation and translation) lies in the lateral shifting of the rear stile of the door or window leaf with respect to the dormant frame, thus providing a free space permitting the access to the outer glazed surface. This feature is particularly advantageous when the window is located at a certain height above the ground and is therefore difficult to get at for cleaning the glazed surface.

Notwithstanding the above-mentioned interesting features characterising this known controls device, the latter is not free of various inconveniences. Thus, when the mosquito-nettings are removed from the fixed frame, the access to the mechanism and notably to the operating arm of this control device is particularly easy. Now, this accessibility increases considerably the risks of casualties, for example pinching a finger or else, due generally to the user's carelessness.

To avoid this inconvenience, a control device has been devised which, though based substantially on the characteristic features of the above-described system, comprises a mechanism enclosed, together with the control arm, in fillisters of the fixed frame or dormant and of the side-hung casement. However, this type of control device is relatively expensive due to the necessity of effecting an additional machining of the fillisters which is required for housing the various mechanical component elements of the device.

Another inconvenience observed with the known devices for controlling a casement door or window panel opening to the outside is a certain weakness from the point of view of safety in case of house-breaking. In casement doors or windows opening to the inside the panels are provided, in certain cases, with swinging fittings offering the possibility of keeping the panel ajar while preserving a minimum safety against burglars. In contrast thereto, in the case of casement doors or windows swinging to the outside, the mechanical means connecting the control device to the panel concerned when the latter is ajar consists only of the operating arm. Under these conditions, and considering the relatively long lever arm involved, the control device has a limited resistance and would deteriorate rapidly in case of attacks against the front stile of the swinging panel.

The above-mentioned problems can be solved by disposing the control device as close as possible to the front stile of the swinging panel, so as to reduce the lever arm accordingly. Under these conditions, the angle of rotation that could be contemplated for the swinging panel by virtue of this control device would be strongly limited and, in any case, less than ninety degrees.

SUMMARY OF THE INVENTION

It is the essential object of the present invention to avoid the various inconveniences set forth hereinabove. Thus, the present invention provides an adequate solution for the problem consisting in devising a device for controlling a side-hung or swinging panel of a door or window opening to the outside, this control device comprising a casing secured to the bottom sill of the dormant or fixed frame of the door or window, this casing enclosing a mechanism actuated by a crank for controlling the rotation of an operating arm provided at one end with a roller engaging a guide rail secured to the panel, said control device further comprising protection means for preventing the access to the operating arm, notably at the beginning and at the end, respectively, of the opening and closing movements of the door or window panel, and means for locking the panel in any desired angular position with respect to the fixed frame.

The advantages deriving from this invention lie essentially in that the protection means eliminate all risks of accident, such as pinching a finger or other trouble, during the actuation of the door or window panel. On the other hand, the provision of locking means avoids any possible consequential effect or backlash on the control device when an effort is exerted on the front stile of the door or window. Moreover, due to their close proximity to the front stile of the swinging panel, the locking means reduce considerably the magnitude of the efforts likely to be exerted thereon, while permitting the rotation of the swinging panel through an angle substantially equal to, or greater than, ninety degrees.

BRIEF DESCRIPTION OF THE DRAWING

FIG. 1 is an exploded, diagrammatic, fragmentary and perspective view of a side-hung casement door or window provided, according to the invention, with a control device according to a first form of embodiment (the locking means being omitted from this Figure);

FIG. 2 illustrates diagrammatically, in elevational and sectional view, a control device of the type shown in FIG. 1, fitted to the bottom sill of a fixed frame, according to a first form of embodiment;

FIG. 3 is a view similar to FIG. 2 showing a control device fitted to the bottom sill of the fixed frame, according to another form of embodiment;

FIG. 4 is a diagrammatic sectional and plane view from above of a casement door or window provided with a different form of embodiment of the control device according to the invention, the locking means being omitted, and FIG. 5 is a diagrammatic, sectional and plane view of a casement door or window equipped with the control device illustrated in FIG. 1, and the locking means associated therewith.

DESCRIPTION OF THE PREFERRED EMBODIMENTS

Figure 6:
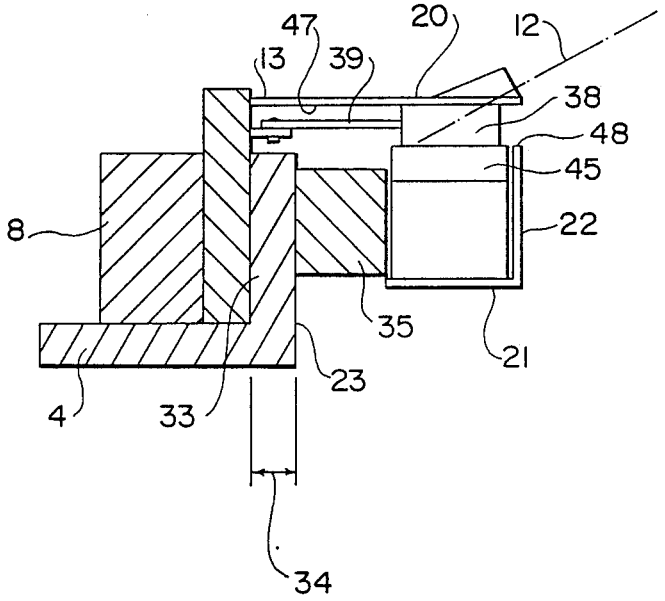
FIG. 6 is a diagrammatic, sectional and plan view of a casement door or window equipped with a control device in accordance with the present invention showing pivoting base members secured to the inner surface of the top wing and a gap between a portion of the top wing and the top edge of the vertical bottom of the device to permit passage of the rear end of the arm.

Referring first to FIG. 1 of the drawing, the control device 1 according to the present invention is utilized notably in the case of a side-hung casement door or window opening to the outside. This Figure illustrates diagrammatically a window opening to the outside. The Figure illustrate provided, on its bottom sill 4, with a control device 1 of this type. The function of this control device 1 consists in actuating the swinging panel 5 from inside the house, without requiring any direct intervention from the user on this panel 5.

The control device 1 comprises a casing 6 for housing a mechanism actuated by a crank (not shown) for controlling the rotation of an operating arm 7 connected to the swinging panel 5. The casing 6 is advantageously secured to the bottom sill 4 of the door or window frame 3. With this arrangement it is unnecessary to machine the fillister of this bottom sill 4 and the fillister of the bottom sill 8 of the swinging panel 5 of the casement door or window.

The mechanism of the control device 1 to which reference is made hereinabove is not shown in the various Figures of the drawing since it is well-known to those conversant with the present state of the art. However, it may be reminded that this mechanism comprises an endless screw adapted to drive for rotation, either via a pinion or directly, the operating arm 7, the latter being driven for example directly by machining rack teeth on its end inserted in the casing 6. A crank (not shown) is used for actuating the endless screw. For this purpose, the casing 6 has formed in a cover 9 a boss 10 having a hole 11 through which one end of the endless screw projects and has fixed thereto, through suitable means, the aforesaid crank. To prevent the bottom sill of the window from interfering with the rotation of this crank during the actuation of the casement leaf 5, the axis of rotation 12 (see FIGS. 1, 2 and 3) of the endless screw forms an angle of about thirty degrees to the horizontal.

The casement leaf 5 is connected to the operating arm 7 by means of a roller 13 carried by the end of the arm 7 and slidably engaged in a guide rail 15 secured to the bottom sill 8 of the swinging leaf 5.

As shown in FIG. 1, the control device 1 and notably the casing 6 thereof are disposed in the vicinity of the rear jambs 16, 17 of the dormant frame 3 and leaf 5, respectively. With this arrangement, the control device 1 is capable of rotating the casement leaf 5 through an angle of about ninety degrees.

According to the present invention, the control device 1 comprises protection means 18 for the purpose of preventing the access to the operating arm 7, notably at the beginning and at the end, respectively, of the opening and closing movements of the door or window leaf 5.

Referring now to FIGS. 1–3 of the drawing, according to a first form of embodiment the aforesaid protection means 18 consist of a channel section member 19 open laterally and comprising two horizontal wings 20, 21 interconnected by a vertical bottom 22. This section member 19 is fixed to the inner face 23 of the sill 4 of dormant frame 3, so that the vertical bottom 22 be opposite the window 3. Moreover the top wing 20 overlies the horizontal plane 24 passing through the guide rail 15. Advantageously, the width 25 of the to wing 20 of this section member 19 is greater than the width 26 of the bottom wing 21 and so calculated as to cover completely said guide rail 15 when the side-hung casement door or window panel 5 is closed. Due to this specific feature characterising the section member 19, the component elements of the mechanism and notably the operating arm 7 are safely protected to prevent any access of the used or any other person thereto, during the critical moments of the actuation of the side-hung casement leaf 5. These critical moments occur when the various moving parts are very close to one another, notably at the beginning and at the end of the opening and closing movements, respectively, of said door or window panel or leaf 5, i.e. when the risks of jamming one's fingers or damaging the control device 1 with an object or tool introduced unduly into the mechanism are more pronounced.

Preferably, the U-section member 19 constituting the protection means 18 extend substantially throughout the length of the bottom sill 4 of the fixed frame 3 and covers the casing 6. For this purpose, a notch 27 is formed in the top wing 20 of this member 19 and adapted to receive the boss 10 formed on the cover 9 of casing 6.

This U-section member 19 may be fixed in position to the frame 3 by using screws, clips or any other suitable fastening devices. On the other hand, the ends 28, 19 of this U-section member 19 are closed by plates 30, 31 secured to, and extending at right angles from, the bottom sill 4. Advantageously, these end plates 30, 31 comprise means for fixing the above-mentioned U-section member 19.

In FIG. 2, the shape of the sill 4 of dormant frame 3 is such that the control device 1 can be fixed directly to the inner face 23 thereof. However, in certain cases the shape of this bottom sill 4 may vary, notably as far as the thickness 32 of the inner ledge 33 is concerned. Thus, in FIG. 3, similar to FIG. 2, the sill 4 has an inner upraised wing 33 having a relatively reduced thickness 34. Under these conditions, fixing the control device 1 to the sill 4 requires the use of a spacer 35 permitting a substantial increment in the width of the inner wing 33 until the desired dimension is obtained.

Referring now to FIG. 4, the protection means 18 according to the above-described form of embodiment are not capable of covering the operating arm 7 during the complete rotational or swinging movement of panel 5. To avoid this inconvenience and according to a second form of embodiment of the control device 1, the top wing 20 of the U-section member 19 is divided into two portions 36, 37, the first portion 36 located between the front stile 44 of leaf 5 and the boss 10 being detachable and secured above the guide rail 15 to the bottom rail 8 of said leaf 5. With this arrangement, the first portion 36 of top wing 20 can cover the operating arm 7 throughout the movement of said leaf 5.

In FIG. 5, the control device 1 comprises likewise means 38 for locking the door or window leaf 5 irrespective of its angular position. Due to this specific feature of control device 1, any effort exerted on the leaf 5 is transmitted to the locking means 38, not to the mechanism enclosed in casing 6.

Also preferably, these locking means comprise an arm 39 having one end 40 hingedly connected to the door or window leaf 5, the other end 41 of this arm 39 being slidably engaged in a locking device 42 rigidly secured to said U-section member 19. It is also preferably that said locking means 38 be located in the vicinity of the front stiles 43, 44 of fixed frame 3 and swinging leaf 5, respectively.

According to the form of embodiment shown in FIG. 5 the locking device 42 is secured to the top wing 20 of U-section member 19 and comprises a pivoting member 45 provided with a case 46 housing a locking member, such as a barrel or the like, cooperating with said arm 39. It is also possible, within the scope of the invention, to insert this locking device 42 in said U-section member 19 and to fix the pivoting member 45 to the inner surface 47 of its top wing 20. In this case, a horizontal groove should be machine in the vertical bottom 22 of said U-section member 19 to permit the passage of the rear end 41 of arm 39 during the rotation of the window or door leaf 5.

However, this locking device 42 cannot be fixed to the top wing 20 if the latter is divided into two portion 36, 37, the front portion 36 being detachable and secured to the leaf 5. Under these conditions, a spacer should be fitted under the pivoting member 45 of locking device 42 to enable the assembly to bear on the lower wing 21 of section member 19. Moreover, a gap must be left between the top edge 48 of vertical bottom 22 and the portion 36 of top wing 20 to permits the passage of the rear end 41 of arm 39.

What is claimed is:

1. A device for controlling the side-hung leaf of a door or window comprising: a casing secured to an inner face of a sill of a dormant frame and adapted to house a crank-driven mechanism controlling rotation of an operating arm provided at one end with a roller engaging a guide rail fixed to a leaf, said crank-drive mechanism comprising protection means for preventing access to the operating area at the beginning and at the end, respectively, of opening and closing movements of said leaf, and means for locking said leaf irrespective of an angular position of said leaf with respect to the dormant frame.

2. The control device according to claim 1, wherein said protection means comprises a U-section member open laterally and comprising a pair of parallel horizontal wings interconnected by a vertical bottom, said U-section member being fixed to an inner surface of the sill of said dormant frame, a top wing of said U-section member having a width sufficient to cover completely said guide rail secured to said leaf.

3. The control device according to claim 1, which comprises protection means comprising a U-section member secured by means of a spacer inserted between said U-section member and the inner surface of the sill of said dormant frame.

4. The control device according to claim 1, which comprises protection means comprising a U-section member extending throughout a length of said sill of said dormant frame and covering said casing, said U-section member comprising a top wing having a notch engageable by a boss formed on said cover of said casing.

5. The control device according to claim 1, which comprises a casing having a cover formed with a boss, and protection means comprising a U-section member having a top wing divided into two portions, a first portion, located between said boss and the front stile of said leaf, being detachably secured to a bottom rail of said leaf above said guide rail.

6. The control device according to claim 1, which comprises protection means comprising a U-section member fixed to the inner surface of the bottom sill of the fixed frame of the door or window, and locking means comprising an arm having one end connected via pivot means to said leaf, another end of said arm being slidably engaged in a locking device fixed to said U-section member, said locking means being secured in close vicinity of a front jamb and front stile, respectively, of said fixed frame and to said door or window leaf.

7. The control device according to claim 6, wherein said locking device comprises a pivoting base member provided with a casing for housing a locking member adapted to cooperate with said arm.

8. The control device according to claim 6, which comprises protection means comprising a U-section member having a top wing to which a pivoting base is secured, said pivoting base corresponding to a locking device cooperating with an arm connected to the door or window leaf and comprising said locking means.

9. The control device according to claim 6, which comprises protection means comprising a U-section member having a top wing, a bottom wing and a vertical bottom, said top wing being divided into two portions, one portion being detachable and secured to the door or window leaf, and a hand locking means comprising an arm connected via pivot means to said door or window leaf and cooperating with a locking device housed in said U-section member and comprising a pivoting base member secured to the inner surface of said top wing, a gap being left between said one portion of said top wing and the top edge of said vertical bottom to permit the passage of the rear end of said arm.

10. The control device according to claim 6, which comprises protection means comprising a U-section member having a top wing, a bottom wing and a vertical bottom, said top wing being divided into two portions of which one portion is detachable secured to said door or window leaf, and a hand locking means comprising an arm connected via pivot means to said door or window leaf and cooperating with a locking device housed in said U-section member and comprising a pivoting base member bearing through the medium of a spacer on said bottom wing, and a gap left between the upper edge of said vertical bottom and said one portion of said top wing for the passage of the rear end of said arm.

* * * * *